United States Patent [19]

Tardo

[11] Patent Number: 5,033,093

[45] Date of Patent: Jul. 16, 1991

[54] COMPACT MICROPHONE AND METHOD OF MANUFACTURE

[75] Inventor: Timothy B. Tardo, Meridian, Miss.

[73] Assignee: Peavey Electronics Corporation, Meridian, Miss.

[21] Appl. No.: 466,599

[22] Filed: Jan. 17, 1990

[51] Int. Cl.[5] ..... H04R 25/00; H04R 7/00

[52] U.S. Cl. ..... 381/177; 181/157; 181/167; 381/163; 381/188; 381/192

[58] Field of Search ..... 381/114, 158, 159, 163, 381/173, 184, 187, 188, 190, 192, 194, 168, 177; 181/170, 171, 157, 167

[56] References Cited

U.S. PATENT DOCUMENTS

| | | | |
|---|---|---|---|
| 1,487,013 | 3/1924 | Clifton | 181/171 |
| 3,041,418 | 6/1962 | Lazzery | 381/163 |
| 3,313,018 | 4/1967 | Tibbets | 181/170 |
| 3,586,794 | 6/1971 | Michaelis | 381/192 |
| 3,989,905 | 11/1976 | Anderson et al. | 381/159 |
| 4,440,983 | 4/1984 | Facoetti et al. | 179/110 A |
| 4,532,383 | 7/1985 | Willy | 179/115.5 |
| 4,535,205 | 8/1985 | Ravinet et al. | 381/114 |
| 4,736,435 | 4/1988 | Yokoyama et al. | 381/188 |
| 4,761,817 | 8/1988 | Christie | 381/194 |
| 4,817,165 | 3/1989 | Amalaha | 381/202 |

FOREIGN PATENT DOCUMENTS

| | | | |
|---|---|---|---|
| 0029724 | 3/1977 | Japan | 181/167 |
| 0045227 | 4/1978 | Japan | 181/167 |
| 002579 | 3/1982 | Japan . | |

OTHER PUBLICATIONS

Electro-Voice, "Electronics World" Apr. 1970, Back Cover.

Chi-Yie Chan, "Hi-Fi Stereo Device", p. 147-Fig. 4-74, Jan. 1975 (Reference A).

Amamoto, "The Design and Manufacture of a Speaker", Chapter 6, Figs. 6-1, 6-2, Nov. 1978 (Reference B).

*Primary Examiner*—Jin F. Ng

*Assistant Examiner*—William Cumming

*Attorney, Agent, or Firm*—Watson, Cole, Grindle & Watson

[57] ABSTRACT

A microphone has a diaphragm having a dome central portion being formed of laminate of a thin layer of synthetic resinous material and a thin wire mesh contacting the central portion. As surrounding attachment portion is provided so that the diaphragm is free to vibrate in a plane perpendicular to itself. An annular voice coil is attached to and circumscribes the central portion on the concave side of the diaphragm and a fixed permanent magnet is disposed within the voice coil. The magnet is formed of neodymium iron-boron and the voice coil has an internal diameter greater than its thickness and the thickness of the magnet is greater than the thickness of the voice coil. A method of forming the described microphone is also set forth.

12 Claims, 2 Drawing Sheets

COMPACT MICROPHONE AND METHOD OF MANUFACTURE

BACKGROUND OF THE INVENTION

This invention is directed to microphones of the dynamic or moving-coil type and to the method of making them.

It is traditional in such microphones to employ AlNiCo magnet structure and small area or diameter diaphragms. A small area diaphragm is beneficial because it means that both the diaphragm and voice coil attached to it present low mass so that the microphone is relatively insensitive to handling or to shock which could produce spurious noise. At the same time, a small diameter voice coil is compatible with AlNiCo magnets which require a high ratio of height-to-diameter (i.e., a "cylindrical" shape) in order to avoid the serious effects of self-demagnetization. Unfortunately, AlNiCo magnet designs also have a low level of flux density in the voice coil gap so that these traditional microphones have inferior acoustic sensitivity compared with modern microphones such as the "condenser" designs. Even if one were to increase the diameter of the AlNiCo magnet to improve the acoustic sensitivity, the penalties paid in increased magnet and consequent microphone sizes, not to mention the penalties paid in increased masses due to increased sizes of both the diaphragm and the voice coil, plus the penalty paid in increased mass due to the need to stiffen or compensate for the increased diameter of the diaphragm, render that approach impractical.

Thus, it will be seen that features of both the diaphragm and of the magnetic circuitry play interrelated and mutually incompatible if not mutually exclusive parts in the efficacy of dynamic microphones insofar as improvements in their acoustic sensitivity and decrease in their handling or shock sensitivity are concerned. The prime function of a microphone diaphragm is to act as a receptor for acoustic pressure waves and to convert such waves into physical force or motion at the attached transducer, in this case the voice coil in its magnetic air gap. The diaphragm must have sufficient stiffness in the plane of its major face so that it will behave as a piston and, on the other hand, the means used to support the edge of the diaphragm in the direction normal to its major face must be compliant as possible to permit easy travel of the diaphragm in such normal direction. At the same time, the diaphragm and its edge mounting must be relatively rigid radially to prevent radial motion of the voice coil and to confine its motion in the axis of the air gap. The diaphragm and its edge mounting must also be resilient enough to return the coil axially to its mid-position at the frequency and amplitude of the acoustic waves bring treated, due regard being had for the overall mass of the whole moving system.

BRIEF SUMMARY OF THE INVENTION

I have discovered that it is possible to make an improved dynamic microphone having increased acoustic sensitivity and a low level of shock or of handling sensitivity if fabrication techniques involving the use of diaphragm lamination employing a layer of metal mesh is combined with the use of a Neodymium-Iron-Boron magnet having a "coin" shape (i.e., having a high ratio of diameter-to-height) and a voice coil having a diameter accepting the magnet.

It is accordingly an object of this invention to provide an improved dynamic microphone employing a Neodymium-Iron-Boron magnet of coin shape in association with a voice coil of large internal diameter receiving such magnet and a diaphragm of low mass stiffened by a layer of metal mesh.

Another object of the invention resides in the incorporation of a thin-wire metal mesh as a component of a domed layer of a diaphragm laminate surrounded by a semitorroidal annulus.

In another aspect of the invention, an objective is to provide an improved dynamic microphone using a coin-shaped or wafer-like permanent magnet in association with a diaphragm having a multilayer dome central portion incorporating a layer of thin wire metal mesh carrying a voice coil of large diameter and small height, the ratio of diameter-to-height being at least about 10:1.

Another object of this invention is to provide an improved dynamic microphone employing a Neodymium-Iron-Boron permanent magnet having a ratio of diameter-to-height which is at least about 7:1 in conjunction with a voice coil of a diameter slightly larger than that of the magnet and in which the central portion of the diaphragm carrying the voice coil is stiffened by a dome shape in which a layer of thin-wire metal mesh is incorporated.

Another object of the invention is to provide an improved dynamic microphone according to the immediately preceding object wherein the dome shape encompasses about 40% of the total area of the diaphragm.

Other objects and advantages of this invention will be apparent as this description proceeds.

BRIEF DESCRIPTION OF THE DRAWING FIGURES

DETAILED DESCRIPTION OF THE INVENTION

Figure 1:
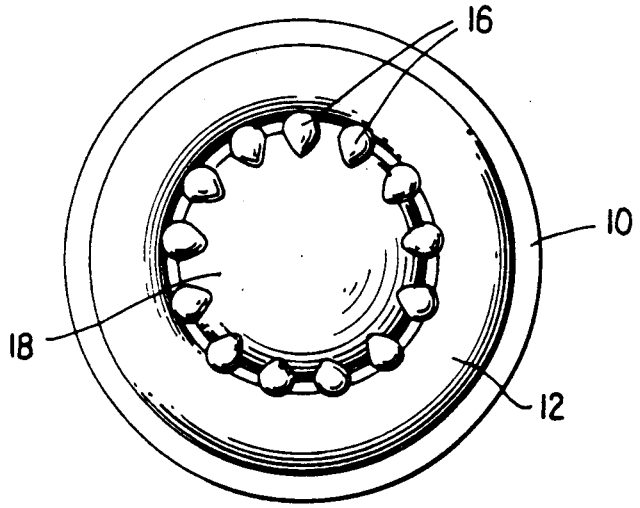
FIG. 1 is plan view of the diaphragm of the invention, the central patch being omitted for the sake of clarity.

Before describing the structural details of this invention by reference to the drawing Figures, it is well to discuss the method of making the invention. Such method involves the step of forming a preliminary laminate which is a thin film of synthetic resinous material having a plastic adhesive (adhesive such as SCOTCH-GRIP 1099-L nitrile rubber base adhesive available from 3M) sprayed onto one face thereof, with drying, and a sheet of fine mesh metal wire in face-to-face contact with the dry adhesive and initially tacked to it by hot ironing the thin film with applied adhesive onto the wire mesh. This preliminary laminate is cut, by stamping, into circular central patches and each central patch is plastically deformed, without heat, partially into final shape. A larger circular body is stamped from a separate thin film of the synthetic resinous material.

The partially deformed patch serves to allow accurate positioning of the larger circular body centrally of it. The result is a multi-layer entity in which the mesh side of the partially deformed central patch engages centrally on the larger circular body. The multi-layer entity is then subjected to heat and pressure between a lower male die and an upper female die forming the final diaphragm shape by thermal and plastic deformation while penetrating the adhesive through the mesh and curing it to bond the synthetic resinous layer of the central patch to the synthetic resinous layer of the larger circular body together (while penetrating and capture-bonding the mesh).

The voice coil is wound in multi-layer form and adhered in that form by the polyvinylbutyral coating on such wire. The diameter of a voice coil is slightly smaller than the diameter of a circular patch. The voice coil is wound with an even number of coil layers so that the two leads at the opposite ends of the coil wire are at the same end of the coil height and therefore may lie close to or against the face opposite the face contacted by the mesh and extend radially outward in free fashion for ultimate connection to the output circuitry in conventional fashion. However, the delicate leads may be locally adhered to a peripheral edge portion of the larger circular body so as to anchor them securely after the voice coil is adhered in place and before they are soldered in place.

With reference to FIG. 1, the final shape of the diaphragm will be seen, although it is to be understood that the drawing figure omits the overlying central patch for the sake of clarity. As shown, the finished diaphragm has an annular outer securing edge flange 10 by which the diaphragm assembly is mounted, an annular semitoroidal portion 12, the interrupted, depressed ring area 14 with circumscribing and interrupting upwardly struck flute portions 16 and, finally, the central dome portion 18. As noted above, the thin film from which the larger circular body is made is a synthetic resinous material, preferably processed from ULTEM 1000 (unmodified) available from General Electric Company, a polyetherimide resin having exceptional tensile and flexural strengths. The thin film is preferably about 0.0005 inch thick and is drawn under heat and pressure to the final shape shown. The areas 10, 14, 16 and 18 bear the brunt of the pressure and consequently are drawn the most. Not shown in FIG. 1 is the central patch and the voice coil, but the former overlies the central dome portion 18 and the latter is concentric with and directly beneath the interrupted depressed ring areas 14. The two leads from the voice coil are shown by the lines 20 which are dashed in those regions in which they underlie the diaphragm and are solid where they project beyond the diaphragm. The adhesive employed to adhere the voice coil to the interrupted undersurface 22 of the diaphragm assembly (see FIG. 3) is available from LOCTITE and preferably is an instant adhesive known as PRISM 403.

Figure 2:
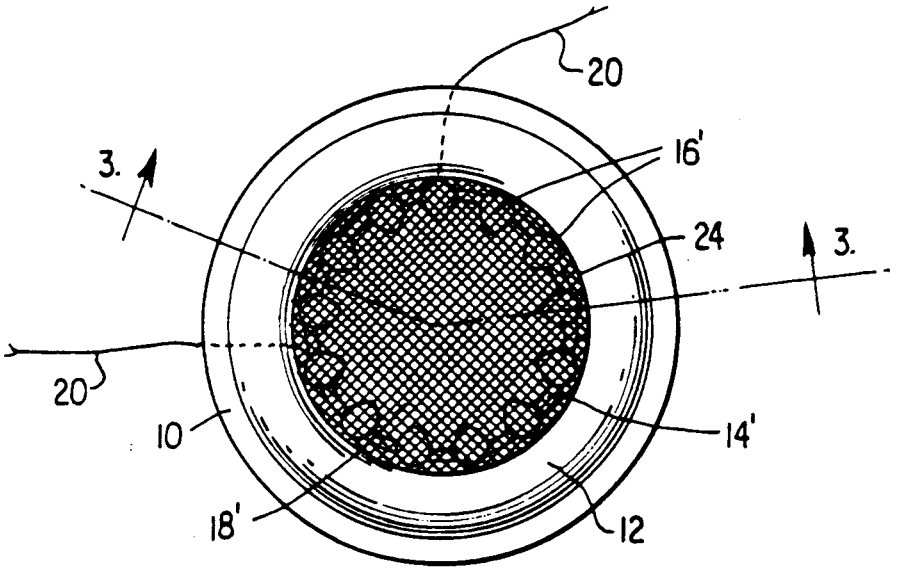
FIG. 2 is a view similar to FIG. 1 but with the central patch.
Figure 3:
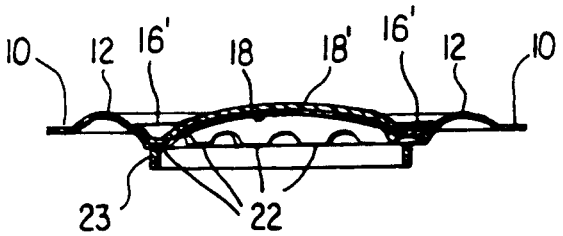
FIG. 3 is a cross-section of the finally shaped diaphragm with the voice coil adhered in place.

Referring to FIGS. 2 and 3, a plan view of the finished diaphragm and a section as indicated in FIG. 2 are shown. As noted before, the larger circular body is first placed in registered position on the smaller, preliminarily deformed circular patch. For this registering, the smaller circular body is first plastically deformed (pressure only) so that it takes on the shape generally of the flutes 16 and the interrupted portions 14. The circular patch entity is then registered with the larger circular portion and the multi-layer entity is finally-deformed between the male and female dies so that it is deformed into final shape as indicated in FIGS. 1–3 before the voice coil 23 is adhered in position as indicated in FIG. 3.

That is to say, the peripheral edge 24 of the circular patch (purposely omitted from FIG. 1 for clarity) as shown in FIG. 2, is coaxial with but lies just outside the boundaries of the flutes 16 and of the interrupted portions 14. After forming into final shape, the central patch has interrupted depressed portions 14' and flutes 16' which are merged onto and formed simultaneously with the portions 14 and 16 previously described in conjunction with FIG. 1 as is the integrated body 18' of the circular patch formed simultaneously and integrated with the domed body 18 of FIG. 1. In FIG. 3, the domed central patch 18' and the domed body portion 18 are shown as a single thickness because they are integral at this time. The diaphragm, minus the voice coil, can easily be handled at this time and the voice coil can be adhered in place on and concentric with the interrupted surface 22 and with its leads 20 adhered to the undersurface of the edge flange 10.

Figure 4:
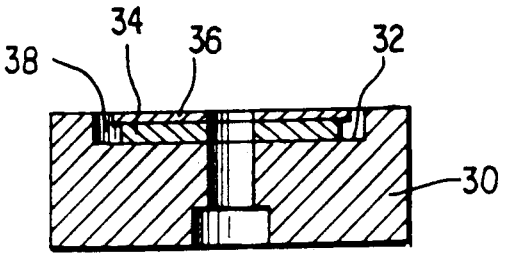
FIG. 4 is a cross-section of the magnet assembly.

The magnet assembly is shown in FIG. 4. It comprises the high permeability steel cup 30 having the upper recess 32 which receives the Neodymium-Iron-Boron magnet 34 and the high permeability pole piece 36. The cup 30 and pole piece 36 may be made of 1215 steel. The annular air gap 38 receives the voice coil 23 with little radial clearance (typically about 0.045"), the internal diameter of the cup recess 32 being about 0.765" in a typical microphone. For this typical microphone, the magnet 34 is formed of a disk having a 0.670" diameter and a 0.100" thickness or height. The magnet, the cup 30 and the pole piece 36, may be provided with a central through bore or aperture as shown. The larger faces of the magnet 34 present north and south faces to abutting structures in the cup 30 and the pole piece 36. Also, it should be noted that the voice coil would have about 350 turns of copper wire in four coil layers, the wire size being 50 AWG with polyvinylbutyral bond.

Figure 5:
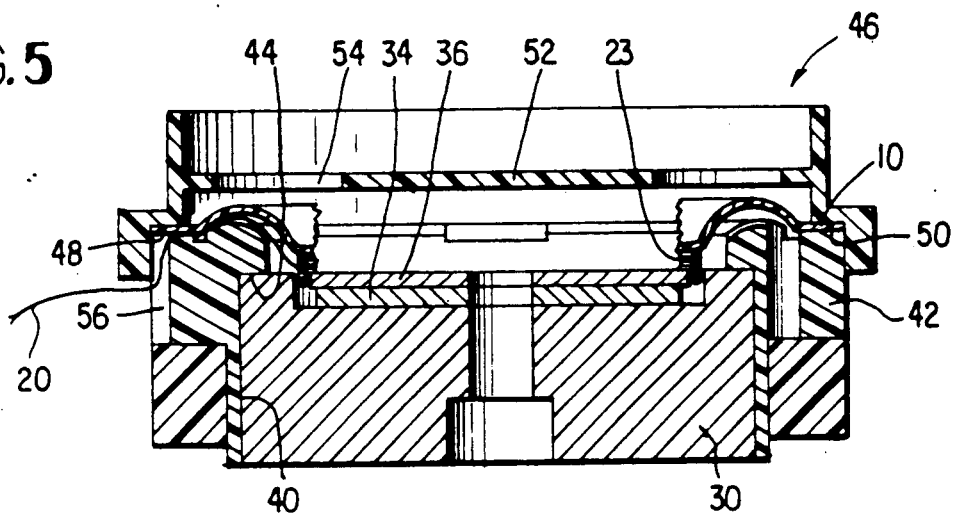
FIG. 5 is a cross-sectional view of the assembled microphone.
Figure 6:
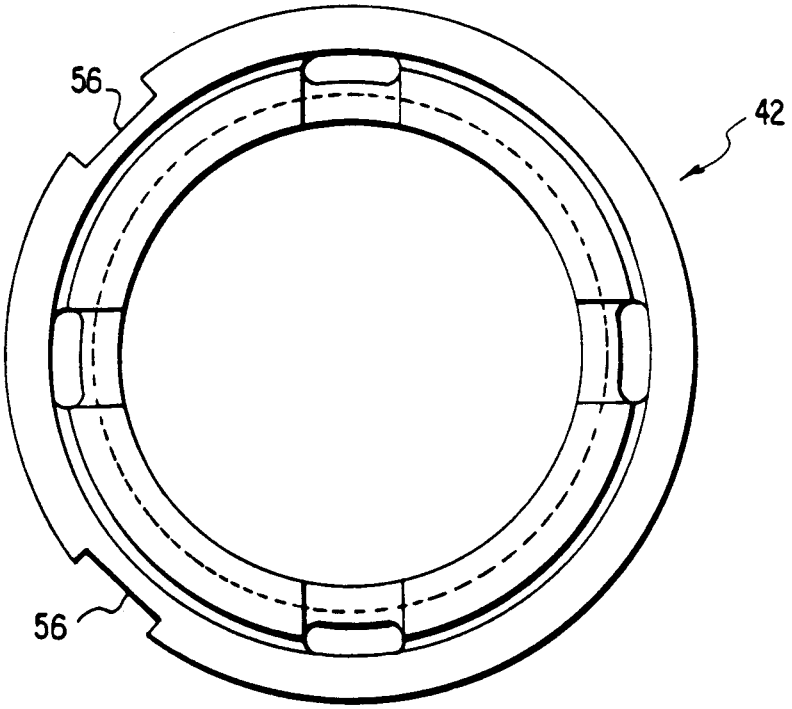
FIG. 6 is a plan view of the housing.

FIG. 5 shows the assembled microphone. The cup 30 of the magnet assembly is received in the bottom recess 40 of housing 42 and bottoms against the overhang 44. The cover 46 has an internal ledge 48 which clamps the edge 10 of the larger circular body peripherally against the housing face 50, the elevated wall 52 of the housing cover providing clearance for the motion of the diaphragm and being provided with a ring of apertures 54 to allow the pressure waves to impinge upon the diaphragm. In equilibrium position, the diaphragm assembly is engaged by the support structure only at its peripheral edge 10 so that the diaphragm is free to flex in both directions normal to its surface. The housing 42 is provided with a pair of vertical recesses, 90° apart, to receive the voice coil leads 20 for soldering. Other housing parts may be provided as deemed necessary or desirable. FIG. 6 is a plan view of the housing 42.

Figure 7:
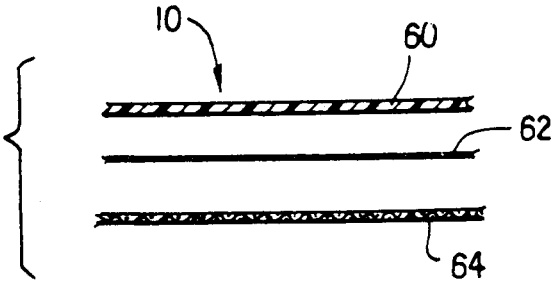
FIG. 7 is an exploded detail of the central patch construction.

To complete the disclosure of the microphone, FIG. 7 has been included to illustrate, in exploded fashion, the details of the preliminary laminate from which the central patches are stamped or cut. As shown, the preliminary laminate consists of the thin film 60 of synthetic resinous material ULTEM 1000 and the spray-applied adhesive SCOTCH-GRIP 1099-L (about 0.001" thick) is indicated at 62. Lastly, the metal wire mesh material is indicated at 64. This material is 50 mesh stainless steel wire having a diameter of 0.0012" and of a roll width of 40", normally used for electrostatic shielding and available from the Swiss company TETKO INC. As noted before, the ULTEM 1000 material with the 1099-L adhesive applied thereto and air dried is hot-ironed onto the mesh material so that the preliminary laminate is tacked to the synthetic resinous material.

Dimensionally, the ratio of diameter-to-height for the permanent magnet typically will be about 7:1 whereas this ratio for the voice coil is typically about 10:1. Taking 0.100" for the magnet thickness or height as a practical lower limit for the Neodymium-Iron-Boron magnet before self-demagnetization becomes a controlling factor, the ratios specified for the magnet and voice coil lead to the condition wherein the thickness or height of the voice coil is about 70% that of the magnet, or 0.070", taking into account that the inside diameter of the voice coil must be slightly larger (0.045" typically) than the outside diameter of the magnet.

Lastly, it should be noted that with the specific materials specified herein and in accord with the preferred configuration and dimensions detailed herein, it can be said that the wire mesh-reinforced central dome should be about 40% of the total area of the diaphragm. This obtains sufficient stiffening to meet the objectives of the invention while maintaining the overall mass of the diaphragm-plus-voice-coil to achieve a dynamic microphone competitive in performance with modern condenser-type microphone designs.

What is claimed is:

1. A method of making a dynamic microphone which comprises the steps of forming a diaphragm body of thin synthetic resinous sheet material of high tensile and flexural strength, forming a multi-layer central portion of thin synthetic resinous material and thin-wire metal mesh, contacting the central portion centrally of the diaphragm body and integrating while deforming both so that they are domed with the diaphragm body on the concave side of the central portion.

2. The method of making a dynamic microphone as defined in claim 1 wherein the thin-wire metal mesh is in face-to-face contact with the diaphragm body.

3. The method of making a dynamic microphone as defined in claim 2 including the steps of forming a voice coil having a diameter commensurate with that of the domed area of the integrated diaphragm and affixing the voice coil to the thin synthetic resinous material of the body in circumscribing relation to the domed area.

4. The method of making a dynamic microphone as defined in claim 3 wherein the permanent magnet is Neodymium-Iron-Boron.

5. A method of making a dynamic microphone which comprises the steps of forming a permanent magnet having opposite faces and a high ratio of diameter-to-height, forming a diaphragm body of thin synthetic resinous sheet material of high tensile and flexural strength, forming a multi-layer central portion of thin synthetic resinous material and thin-wire metal mesh, contacting the central portion centrally of the diaphragm body and integrating while deforming both so that they are domed with the diaphragm body on the concave side of the central portion, the central portion being less than one-half the total area of the diaphragm body, forming a voice coil having a diameter and a diameter-to-height ratio greater than those of the magnet, affixing the voice coil in circumscribing relation to the domed area and on the convex side thereof, locating the voice coil to surround the magnet, and fixing the periphery of the diaphragm relative to the magnet.

6. The method according to claim 5 wherein the magnet has North and South poles on its opposite faces and including the step of enclosing the magnet partially with high permeability material so as to leave an air gap within which the voice coil is partially received.

7. The method as defined in claim 6 wherein the diameter-to-height ratio of the magnet is about 7:1 and the diameter-to-height ratio of the voice coil is about 10:1.

8. A microphone construction comprising the combination of a diaphragm having a domed central portion formed of a laminated thin film of synthetic resinous material and a thin wire metal mesh contacting the central portion and a surrounding attachment portion whereby the diaphragm is free to vibrate in a plane normal to the diaphragm, an annular voice coil attached to and circumscribing the central portion on the concave side thereof, and a fixed permanent magnet disposed within said voice coil, said magnet being of neodymium-iron-boron composition and of disc shape, the voice coil having an internal diameter greater than its thickness and the thickness of the magnet being greater than the thickness of the voice coil.

9. A microphone construction as defined in claim 8 wherein the area encompassed by the central portion of the diaphragm is about 40% of the total area of the diaphragm.

10. A microphone construction as defined in claim 9 wherein the ratio of diameter-to-height of the magnet is at least 7:1.

11. A microphone construction as defined in claim 10 wherein the ratio of diameter-to-height of the voice coil is about 10:1.

12. A compact microphone construction comprising the combination of a diaphragm having a multi-layer laminated, low mass rigid domed central portion including first and second deformable layers and a wire mesh layer adhesively bonded therebetween and a surrounding single layer attachment portion integral with and extending from said second layer, said second layer having high tensile and flexural strength whereby the diaphragm is free to vibrate in a plane normal to the diaphragm, an annular voice coil attached to and circumscribing the domed central portion on the concave side thereof, and a compact magnet assembly including a permeable cup portion having a circular recess with a closed inner wall, an upstanding annular wall portion extending from the inner wall and forming a pole piece, a thin disk shaped fixed permanent magnet disposed within the recess in abutment with the closed wall, and a disk like permeable pole piece disposed over the magnet, said magnet assembly having an annular recess for receiving said voice coil, said magnet being of neodymium-iron-boron composition, the voice coil having an internal diameter greater than its thickness and the thickness of the magnet being greater than the thickness of the voice coil, the mesh having a wire thickness sufficient to impart rigidity to the central portion and having a mesh size to reduce the vibrating mass to thereby render the microphone relatively shock insensitive.

* * * * *